United States Patent [19]

Herzog

[11] Patent Number: 4,590,113

[45] Date of Patent: May 20, 1986

[54] FIBER WOOL PADDING, AND METHOD OF MANUFACTURING SAME

[75] Inventor: Heinz Herzog, Lahr, Fed. Rep. of Germany

[73] Assignee: Oscar Weil GmbH & Co. KG, Lahr, Fed. Rep. of Germany

[21] Appl. No.: 459,881

[22] PCT Filed: May 7, 1982

[86] PCT No.: PCT/EP82/00096

§ 371 Date: Jan. 10, 1983

§ 102(e) Date: Jan. 10, 1983

[30] Foreign Application Priority Data

May 8, 1981 [DE] Fed. Rep. of Germany ..... 3118343

[51] Int. Cl.[4] ..... B32B 3/02

[52] U.S. Cl. ..... 428/92; 28/112; 428/95; 428/131; 428/136; 428/192; 428/285; 428/537.1

[58] Field of Search ..... 428/90, 91, 93, 95, 428/97-99, 134, 137, 138, 300, 139, 92, 537, 136, 131, 192, 285; 28/112, 167; 156/148, 72

[56] References Cited

U.S. PATENT DOCUMENTS

| | | | |
|---|---|---|---|
| 18,001 | 3/1831 | Rayner | 28/107 |
| 430,230 | 6/1890 | Grubb | 28/107 |
| 2,951,278 | 9/1960 | Hoffman | 428/224 |
| 3,205,342 | 9/1965 | Smith et al. | 28/112 |
| 3,245,854 | 4/1966 | Etchison et al. | 28/112 |
| 3,448,502 | 6/1969 | Tesch | 28/112 |
| 3,484,916 | 12/1969 | Johnstone | 28/112 |
| 3,819,465 | 6/1974 | Parsons et al. | 28/112 |
| 4,016,317 | 4/1977 | Kalwaites | 428/137 |
| 4,096,302 | 6/1978 | Thibodeau | 428/137 |
| 4,237,180 | 12/1980 | Jaskowski | 428/300 |
| 4,328,270 | 5/1982 | Kostovski | 428/95 |
| 4,391,866 | 7/1983 | Pickins et al. | 428/92 |

*Primary Examiner*—James J. Bell

[57] ABSTRACT

The invention relates to a fiber wool in band or pad form, e.g., in the form of steel wool, having a plate-like or band-like support, the fiber wool being able to be joined to the support in a simple manner by forcing portions (15) of the fiber wool (14) through perforations (13) in the support (11) and pressing them flat from the opposite side of the support (11).

8 Claims, 6 Drawing Figures

FIBER WOOL PADDING, AND METHOD OF MANUFACTURING SAME

Figure 1:
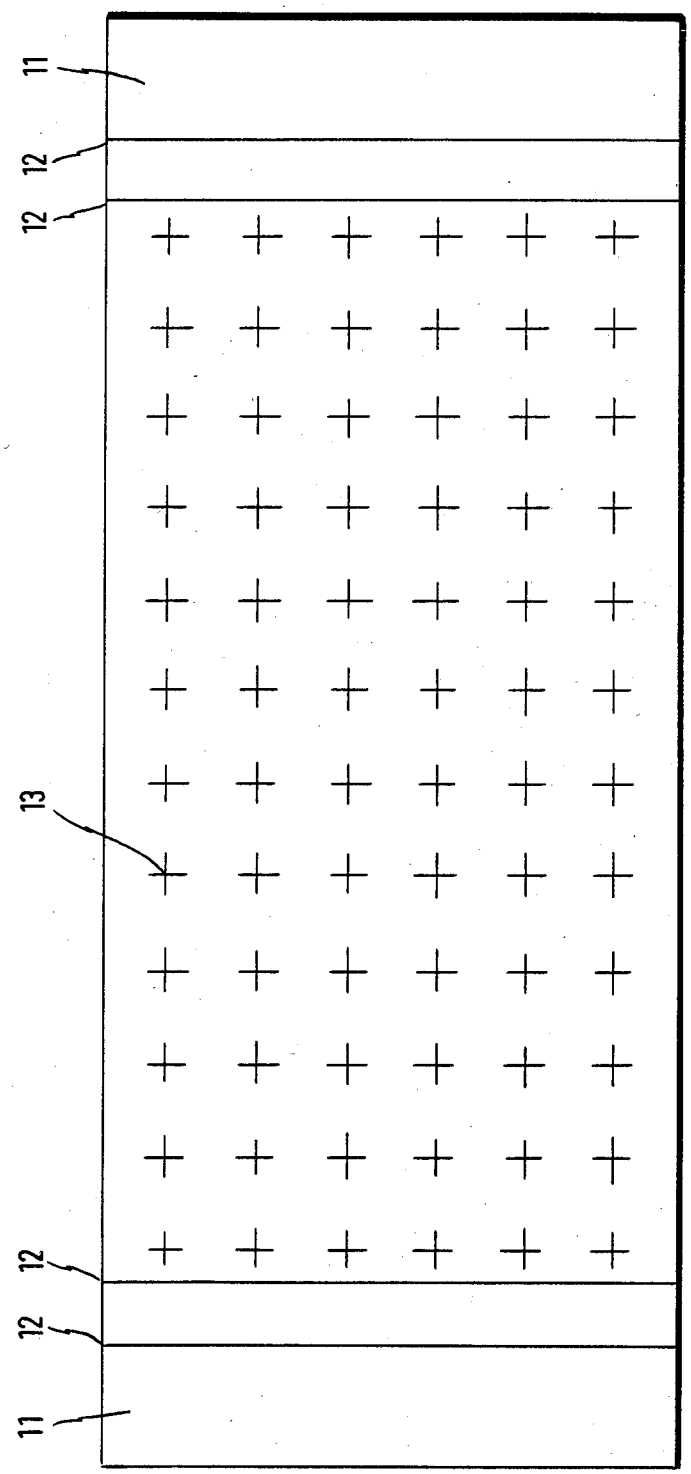

The invention relates to a fiber wool pad and to a method of manufacturing same.

Such a fiber wool pad is known, for example, as steel wool. The use of common steel wool, i.e., steel wool consisting of steel fibers running mainly in one direction, is limited. Its use in hand sanding blocks and vibrating sanders is not possible, since in operation a relative movement would take place between the block bearing the steel wool and the steel wool itself. The steel wool can be cemented to a support and mounted on the sanding and polishing machine. The adhesion, however, is poor, since the contact surface area of the steel wool is small. Furthermore, even after cementing, the steel wool is still flexible, so that the adhesive is easily broken away. The use of adhesive in sanding and polishing machines with rotary disks also has the disadvantage that the cement breaks down at high temperatures. In general, the use of adhesive has the disadvantage that, at low temperatures, it comes to the surface, since all of the steel wool has to be impregnated with adhesive in order to achieve a bond between the steel wool surface and the sander-polisher. It is also known to fasten the steel wool to a support by means of clips or the like. This is not desirable for polishing, since the clips penetrate to the surface of the steel wool.

It is the object of the invention to join a fiber wool pad, especially steel wool, to a support in a simple manner.

This object is achieved in accordance with the "invention by a sandwich material, consisting of a fiber wool and a support, the support having cross-shaped perforations so as to form flaps, portions of the fiber wool extending from one side through the support and forming fiber loops engaged by the flaps and pressed flat against the other side of the support."

In the case of a fiber wool pad in the form of steel wool, the support consists, for example, of paperboard and is pierced with cross-shaped perforations. The face of the support is covered with the steel wool, which is forced from the face through the perforations, in such a manner that on the back side tuft-like projections are formed and the flaps defined by the cross-shaped perforations are bent back. The tuft-like projections consist of loops of the steel wool. At the same time it is important that the fibers of the steel wool be not damaged. If at first the flaps created by the cross-shaped perforations are forced downwardly, they will penetrate the steel wool loops forming the tufts. If the loops are then pressed down, the holding of the steel wool on the support is assured by the fact that the flaps defining the cross-shaped perforations penetrate into the loops and prevent the loops from being pulled back to the face side of the support. The pressing down of the loops is similar to riveting, i.e., the loops are not bent over, but are pressed flat by a vertical pressure.

This type of bond between the steel wool and support results in a secure holding of the steel wool to the support. Relative movement between the support and the steel wool, especially of the steel wool surface, is no longer possible, since by forcing the steel wool through the support, fibers lying on the outer face of the steel wool are also forced through the cross-shaped perforations and held by the flaps.

The usefulness of such steel wool is at least equal to that of conventional steel wool, but this steel wool can also be used particularly in hand sanding blocks or vibrating sanders. In comparison to the use of sandpaper in hand or machine sanders, the advantage is achieved that steel wool can be re-cleaned mechanically, whereas sandpaper breaks down, and that, for example, no circular scratches are produced such as those made by the grit particles when abrasive paper is used.

Furthermore, such steel wool has very great versatility.

On the rolls of laundry ironing machines it is known to use steel wool in band form, winding it spirally onto the rolls. The disadvantage is that the thickness of the steel wool is reduced by the lengthwise shifting of the fibers, i.e., toward their extremities, so that sufficient ironing pressure can no longer be obtained. This disadvantage cannot occur in the new steel wool, since no shifting of the steel fibers is possible.

The steel wool, however, can also be used, for example, in the form of acoustic insulation boards, for electrical insulation (Faraday cage), for the production of protective suiting, etc.

The proposed method of fastening fiber wool to a support is not limited to steel fibers, but is also adaptable to glass fibers, for example.

Figure 2:
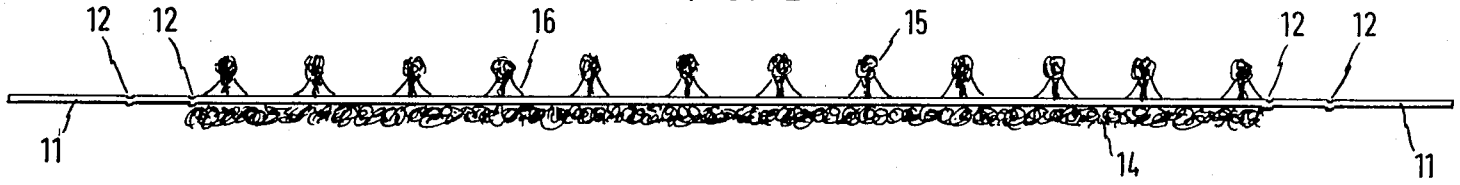
Figure 3:
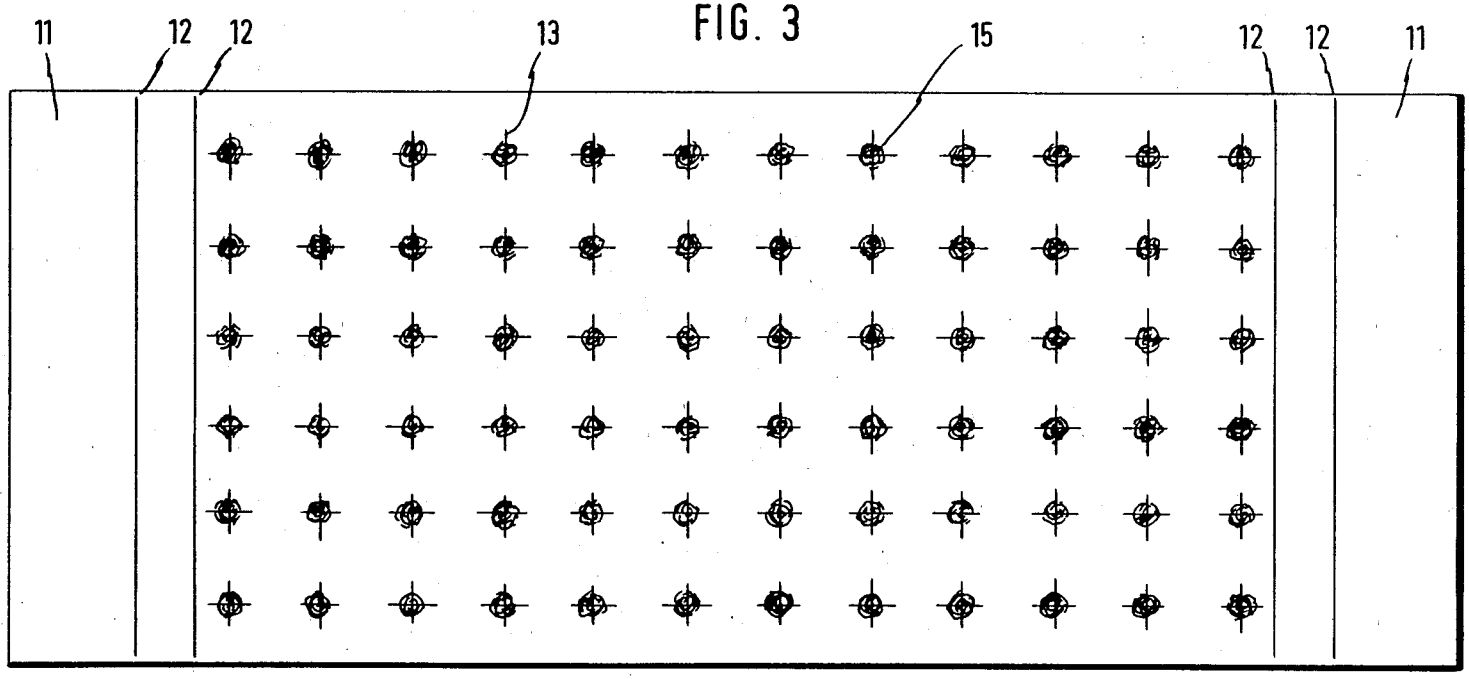
Figure 4:
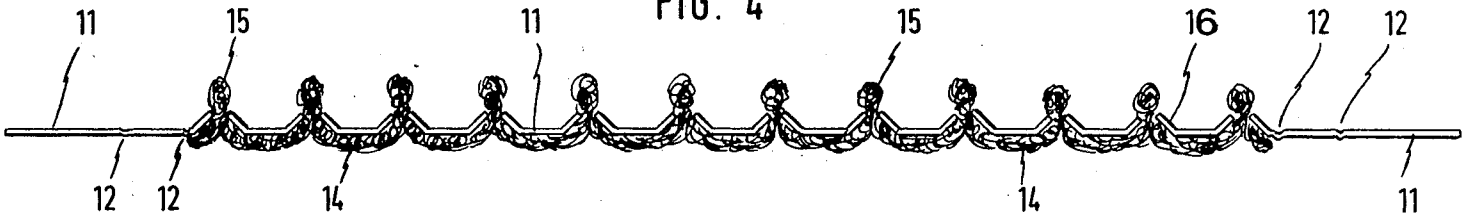
Figure 5:
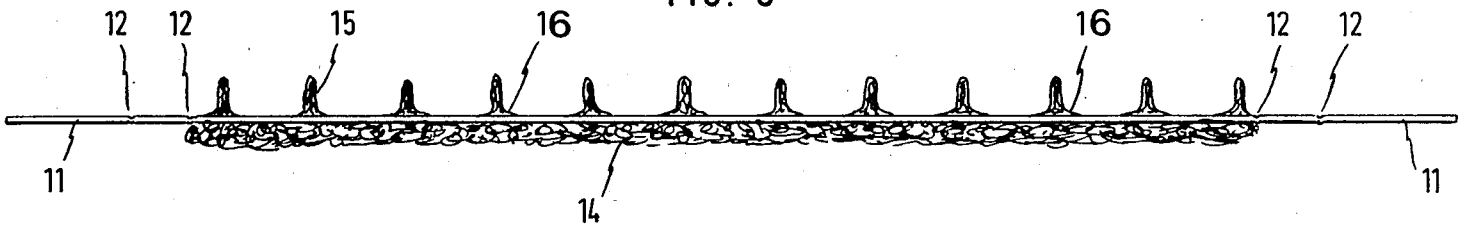
Figure 6:
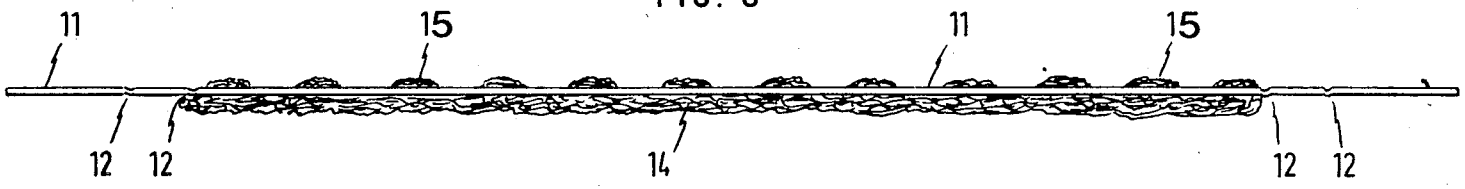

The invention will be explained below by means of an example in conjunction with FIGS. 1 to 6, wherein:

FIG. 1 is a plan view of the support containing the cross-shaped perforations, FIG. 2 is an edge view of the support after the steel wool loops have been forced through it, FIG. 3 is a plan view of the support, corresponding to FIG. 2, FIG. 4 is a cross-sectional view of the support taken through the area of the forced-through steel wool loops, FIG. 5 is an edge view of the support after the flaps have been forced down, and FIG. 6 is an edge view of the support after the loops have been pressed down.

FIG. 1 is a view of a rectangular support 11 made, for example, of paperboard, and having a plurality of rows of cross-shaped perforations 13. Two creases 12 are provided along the end margins of the support so as to enable them to be bent and gripped in a sanding block or vibrating sander.

FIG. 2 shows the support with its face covered with steel wool 14. Portions of the steel wool 14 are forced up from its face through the perforations 13, so that loops 15 in the form of tuft-like projections are created on the back of the support 11. It is important that the fibers of the steel wool are not damaged by being forced through the support 11, since otherwise a perfect hold will not be achieved, and in use the fibers might be pulled back through the support. The flaps 16 formed by the perforations are, as shown in FIG. 2, turned up as the steel wool is forced through.

FIG. 3 is a plane view of the back of the support 11 after the steel wool has been forced through.

FIG. 4 shows a cross section through a row of loops of FIG. 3. From the illustration it can be seen that especially surface portions of the steel wool have been forced through the openings 13. It is precisely these surface portions of the steel wool that are responsible for the fact that, when such a steel wool is used, no relative movement between the steel wool and the support will take place.

FIG. 5 shows an edge view of the support after the flaps 16 have been pressed down. The loops 15 are given a more or less cylindrical shape by the pressing down of these flaps 16.

FIG. 6 shows the flattened or "riveted" loops 18. The loops are now spread over the flaps 17 bent back into the plane of the support, penetrating between the individual fibers of the loops, and thus causing the steel wool to be held onto the support.

In certain cases it may be expedient to use not just one layer of steel wool, but two or more layers, in each of which the fibers are oriented preferably in one direction with the directions preferably crossing at right angles.

I claim:

1. A composite material comprising: a support having a first surface and a second surface opposite the first surface, a plurality of cross-shaped perforations in said support and extending through said support from said first surface to said second surface so as to form flaps in said support at each perforation; and a web of non-woven fibers of considerable length, said web being located on said first surface and having fiber loops extending from the first surface respectively through said perforations and beyond the second surface, said loops engaging the flaps on the second surface.

2. The composite material of claim 1, wherein the web consists of metal wool.

3. The composite material of claim 1, wherein the support consistis of paperboard.

4. The composite material of claim 1, wherein the fibers run substantially in one direction.

5. The composite material of claim 1, wherein the fibers are continuous fibers.

6. The composite material of claim 1, wherein the support has marginal creases for folding marginal portions of the support.

7. The composite material of claim 1, comprising a plurality of layers of webs, with fibers of adjacent layers crossing each other at right angles.

8. A method of manufacturing a composite material, comprising the steps of:

forming cross-shaped perforations in a support from one face thereof to the other so as to form flaps in the support; placing a pre-compressed non-woven fiber web on said one face; forcing portions of the fiber web from the one face through the cross-shaped perforations in the support, so that flaps are bent outwardly by the fiber web portions and the fiber web portions form, on the other face of the support, loops in the form of tuft-like superelevations; pressing the flaps of the cross-shaped perforations back in the direction towards the other face of the support; and pressing the fiber web loops flat onto the flaps of the cross-shaped perforations.

* * * * *